US008240006B2

(12) United States Patent
Lee

(10) Patent No.: US 8,240,006 B2
(45) Date of Patent: Aug. 14, 2012

(54) TRUNK HINGE APPARATUS HAVING POP-UP FUNCTION

(75) Inventor: Dae Hee Lee, Gyunggi-Do (KR)

(73) Assignee: Hyundai Motor Company, Seoul (KR)

( * ) Notice: Subject to any disclaimer, the term of this patent is extended or adjusted under 35 U.S.C. 154(b) by 311 days.

(21) Appl. No.: 12/428,815

(22) Filed: Apr. 23, 2009

(65) Prior Publication Data

US 2009/0282648 A1 Nov. 19, 2009

(30) Foreign Application Priority Data

May 16, 2008 (KR) ..... 10-2008-0045324

(51) Int. Cl.
*E05F 1/08* (2006.01)

(52) U.S. Cl. ..... 16/297; 16/277; 296/76

(58) Field of Classification Search ..... 16/297, 16/277, 321, 333, 343, 374, 286; 296/76, 296/193.08, 193.11, 146.8; 180/69.2, 69.21
See application file for complete search history.

(56) References Cited

U.S. PATENT DOCUMENTS

| | | | | |
|---|---|---|---|---|
| 2,743,476 | A * | 5/1956 | Turner | 16/289 |
| 2,771,629 | A * | 11/1956 | Gessler | 16/289 |
| 3,024,488 | A * | 3/1962 | Germann | 16/306 |
| 6,736,440 | B1 * | 5/2004 | Hashim et al. | 296/76 |
| 7,350,845 | B1 * | 4/2008 | Duffy | 296/76 |
| 7,730,584 | B2 * | 6/2010 | Duffy | 16/304 |
| 7,845,053 | B2 * | 12/2010 | Marsh et al. | 16/357 |
| 2005/0172453 | A1 * | 8/2005 | Duffy | 16/307 |
| 2010/0251519 | A1 * | 10/2010 | Duffy | 16/304 |

FOREIGN PATENT DOCUMENTS

| | | | |
|---|---|---|---|
| KR | 1998-034155 | A | 8/1998 |
| KR | 2002-0085383 | A | 11/2002 |

* cited by examiner

*Primary Examiner* — William L. Miller
(74) *Attorney, Agent, or Firm* — Morgan, Lewis & Bockius LLP

(57) ABSTRACT

A trunk hinge apparatus having a pop-up function includes a hinge bracket mounted to an inner panel, a trunk hinge arm hinged to the hinge bracket, an elastic spring secured to the hinge bracket, a pop-up lever hinged at a first end thereof to the hinge bracket, and elastically biased at a second end thereof by the elastic spring, and a pressure unit mounted to the trunk hinge arm to come into close contact with the pop-up lever. When the spring moves the pop-up lever, the additional arm slides along the pop-up lever, moving the trunk hinge arm.

15 Claims, 5 Drawing Sheets

TRUNK HINGE APPARATUS HAVING POP-UP FUNCTION

CROSS-REFERENCE TO RELATED APPLICATIONS

The present application claims priority to Korean Patent Application Number 10-2008-0045324 filed May 16, 2008, the entire contents of which application is incorporated herein for all purposes by this reference.

BACKGROUND OF THE INVENTION

1. Field of the Invention

The present invention relates to a trunk hinge apparatus which allows a trunk lid to be easily opened.

2. Description of Related Art

A vehicle is provided with a trunk to carry luggage. A trunk lid hinge apparatus mounts a trunk lid to the trunk and functions to open or close the trunk and enables the easy opening of the trunk.

As shown in FIG. 5, a conventional trunk lid hinge apparatus includes two torsion bars which are arranged to cross each other, thus keeping a trunk lid 40 opened. Particularly, one end of a trunk lid hinge 10 is rotatably hinged to a bracket 30 coupled to the lower surface of an inner panel 20, while the other end of the trunk lid hinge 10 is secured to the lower surface of the front of the trunk lid 40, so that the trunk lid 40 and the trunk lid hinge 10 can operate together as one unit.

Further, a gas lifter 50 is installed at the trunk lid hinge 10 to open the trunk lid 40. The gas lifter 50 applies force to the trunk lid hinge 10 via gas pressure, thus allowing a user to easily open or close the trunk lid 40.

However, the conventional trunk lid hinge apparatus is problematic in that the height to which the trunk lid is initially popped-up when it is opened or closed by the operation of a latch is small, so that the opening gap of the trunk lid is narrow, and therefore a user may not recognize the opening state of the trunk lid or may feel inconvenience when opening the trunk lid.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention have been made keeping in mind the above problems and provide for a trunk hinge apparatus having a pop-up function which allows a trunk lid to be easily raised when a trunk is opening.

One aspect of the present invention is directed to a trunk hinge apparatus having a pop-up function, including a hinge bracket mounted to an inner panel, a trunk hinge arm hinged to the hinge bracket, an elastic spring secured to the hinge bracket, a pop-up lever hinged at a first end thereof to the hinge bracket, and elastically biased at a second end thereof by the elastic spring, and/or a pressure unit mounted to the trunk hinge arm to come into close contact with the pop-up lever.

A guide surface may be provided between a pair of jaws on the pop-up lever so that the pressure unit moves along the guide surface and thereby the trunk lid may be popped up when the trunk lid may be opened. The pressure unit may include a support block secured to the trunk hinge arm, a hinge pin coupled to an end of the support block, and/or a pressure roller rotatably fitted over the hinge pin. The guide surface may be concave. A stopper may be provided at a predetermined position on the hinge bracket to limit a rotating angle of the pop-up lever. The stopper may protrude from the hinge bracket in such a way as to be placed on a path along which the second end of the pop-up lever may be rotated.

Other aspects of the present invention are directed to a trunk lid assemblies including a trunk lid and the above-described trunk hinge apparatuses having the pop-up function, and further still, to passenger vehicles including such trunk lid assemblies.

Another aspect of the present invention is directed to a trunk hinge apparatus having a pop-up function, including a hinge bracket, a trunk hinge arm hinged to the hinge bracket, a spring attached to the hinge bracket, a pop-up lever hinged at a first end thereof to the hinge bracket, and biased at a second end thereof by the spring, and/or an additional arm mounted to the trunk hinge arm and slidably contacting the pop-up lever such that when the spring moves the pop-up lever, the additional arm slides along the pop-up lever, moving the trunk hinge arm.

The pop-up lever may include a concave guide surface which the additional arm slidably contacts. The additional arm may include a support block secured to the trunk hinge arm, a hinge pin coupled to the support block, and/or a pressure roller rotatably fitted over the hinge pin. The hinge bracket may include a stopper to limit a rotating angle of the pop-up lever. The stopper may be disposed along a path along which the pop-up lever rotates.

Other aspects of the present invention are directed to a trunk lid assemblies including a trunk lid and the above-described trunk hinge apparatuses, and further still, to passenger vehicles including such trunk lid assemblies.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

BRIEF DESCRIPTION OF THE DRAWINGS

FIGS. 1A and 2B are views illustrating the construction of an exemplary trunk hinge apparatus having a pop-up function according to the present invention.

DETAILED DESCRIPTION OF THE INVENTION

Figure 1A:
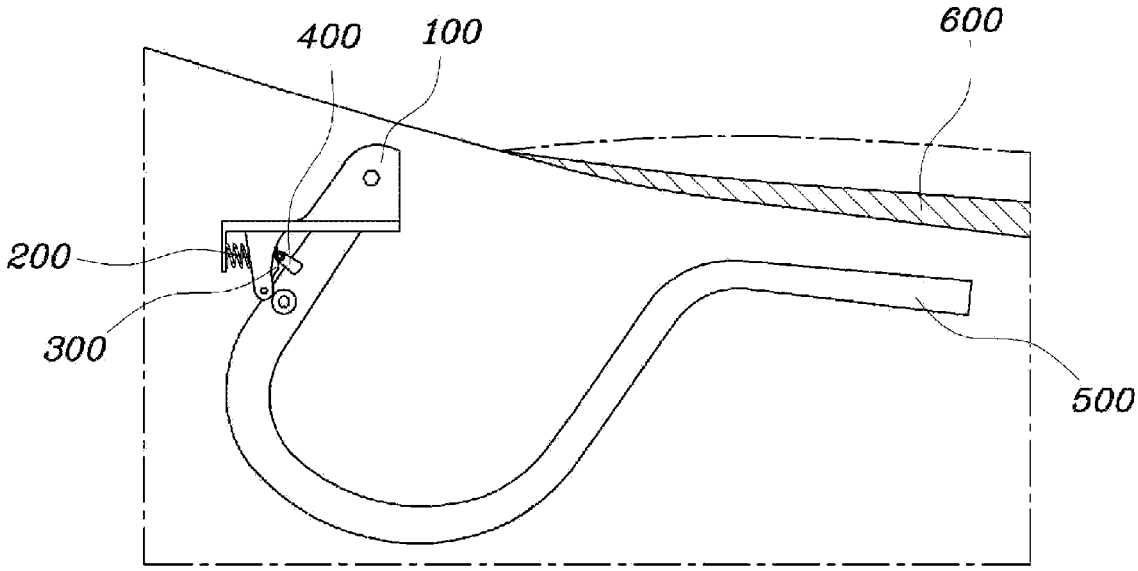
Figure 1B:
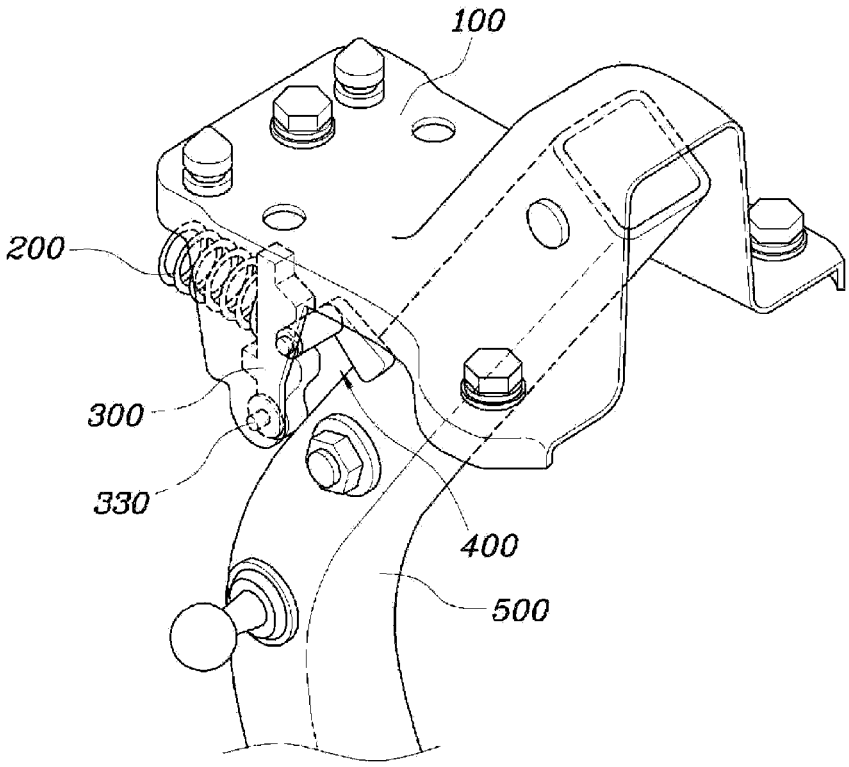
Figure 2:
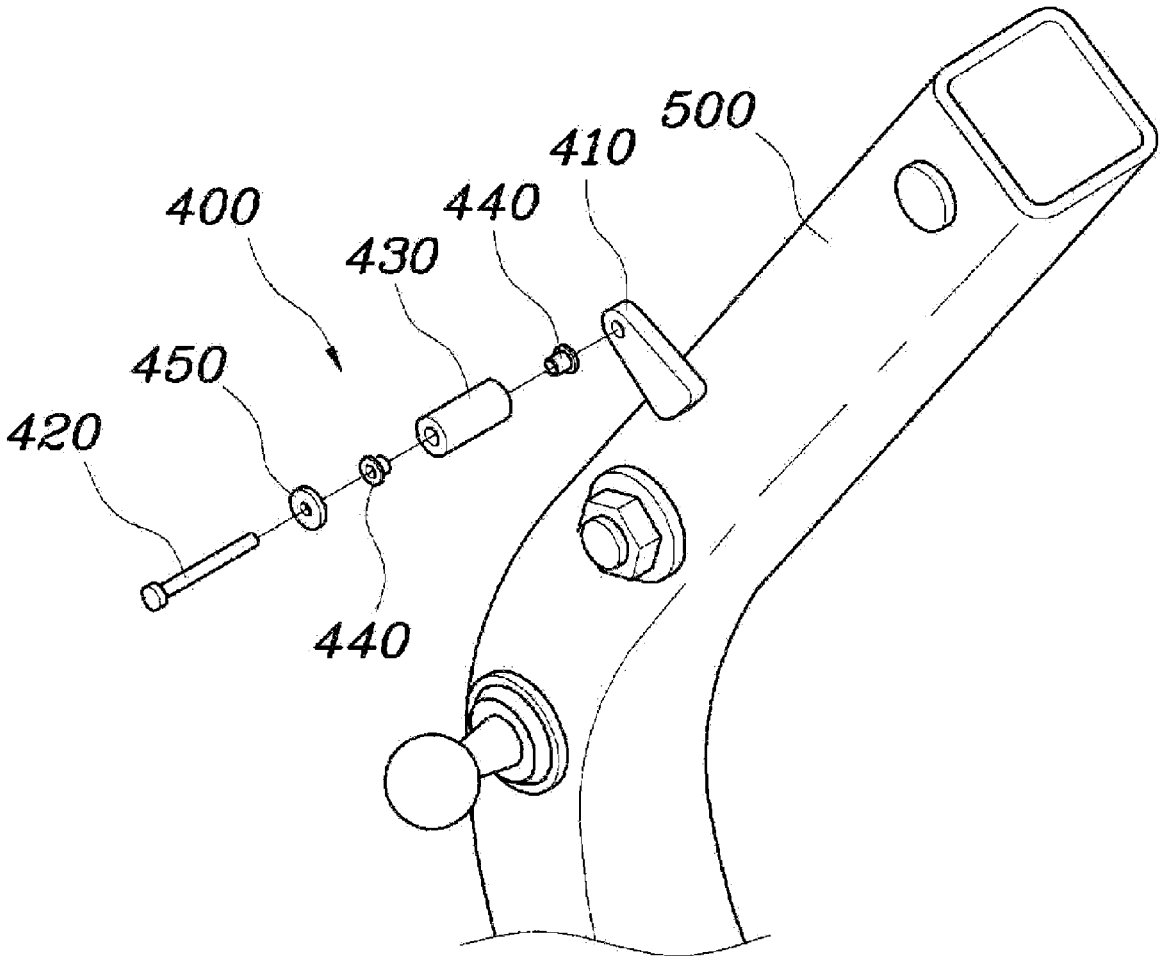
FIG. 2 is an exploded perspective view illustrating an exemplary pressure unit of the trunk hinge apparatus having the pop-up function according to the present invention.
Figure 3A:
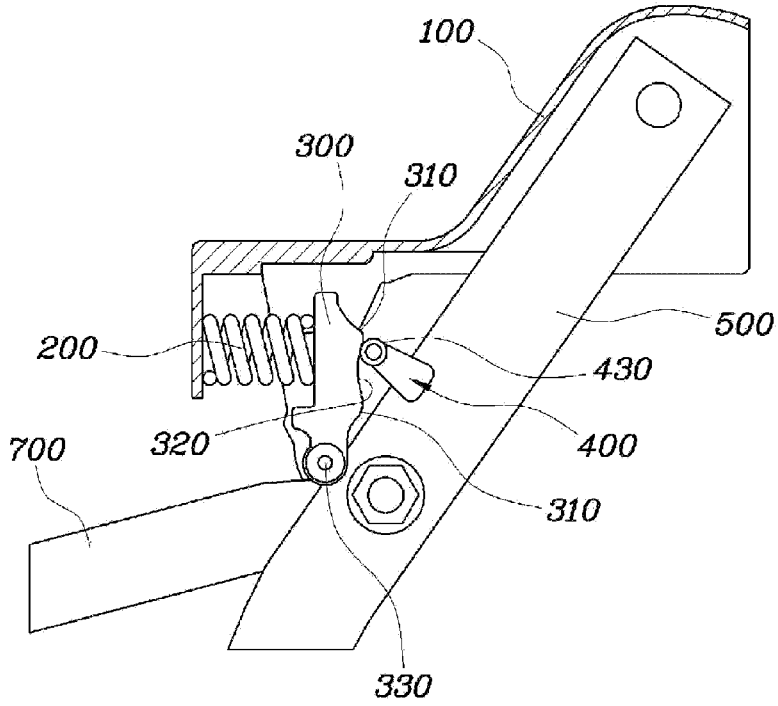
FIGS. 3A and 3B are views illustrating the states before and after the trunk hinge apparatus having the pop-up function according to the present invention is operated.
Figure 3B:
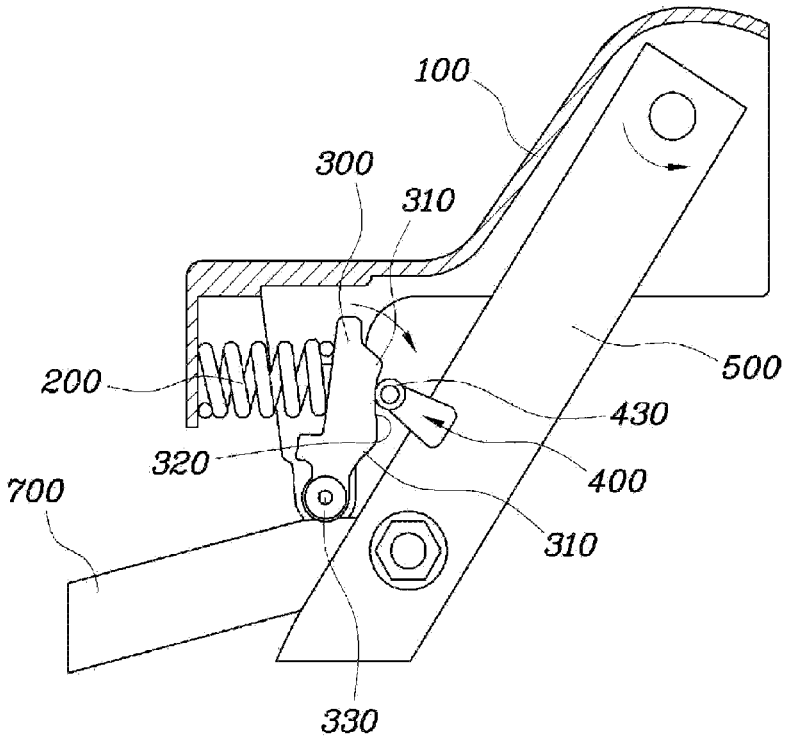

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

As shown in FIGS. 1A to 3B, according to various embodiments of the present invention, a trunk hinge apparatus is constructed so that a trunk lid 600 is opened or closed by a trunk hinge arm 500 which is rotated by a lifter 700. Further, an improved pop-up function is provided so that a user can easily recognize whether the trunk lid is open or not. Here, since the general construction of the trunk hinge arm 500, the lifter 700, and the trunk lid remains the same as the construction of a trunk hinge arm, a lifter, and a trunk lid of an otherwise conventional trunk hinge apparatus for vehicles, the detailed description of the trunk hinge arm 500, the lifter 700, and the trunk lid will be omitted herein.

The trunk hinge apparatus according to various embodiments the present invention includes a hinge bracket 100 which is mounted to an inner panel of a vehicle trunk side, and an elastic spring 200 which is secured to the hinge bracket 100.

The trunk hinge arm 500 is rotatably hinged to the hinge bracket 100. One end of the trunk hinge arm 500 is rotatably hinged to the hinge bracket 100, while the other end is coupled to the trunk lid, so that rotation of the trunk hinge arm 500 causes the trunk lid to be opened or closed. The trunk hinge arm 500 may be directly coupled to the trunk lid 600 or, as shown in FIG. 1A, it may be disposed just below the trunk lid 600 to support and lift the trunk lid 600. An actuating end of the lifter 700 is hinged to the trunk hinge arm 500. The trunk hinge arm 500 may be rotated by the operation of the lifter 700.

The elastic spring 200 is secured to the hinge bracket 100 and is maintained in a compressed state by the trunk hinge arm 500 when the trunk lid is closed. When the trunk lid is released, the elastic spring 200 extends, thus performing the pop-up function. Here, a pop-up lever 300 hinged to the hinge bracket 100 is elastically biased by an end of the elastic spring 200.

One end of the pop-up lever 300 is hinged to the hinge bracket 100 via a lever shaft 330, and the other end is elastically biased by the end of the elastic spring 200. When the trunk lid is released, the pop-up lever 300 may be rotated at a predetermined angle by the elastic spring 200.

A concave guide surface 320 is provided between a pair of jaws or protrusions 310 on the pop-up lever 300. The guide surface 320 is formed to have a concave curved shape, and functions to guide the movement of a pressure unit, an arm 400, when the elastic spring 200 is extended. Thereby, the pop-up operation of the trunk hinge arm 500 can be smoothly performed due to the extension of the elastic spring 200.

The arm 400 is mounted to the trunk hinge arm 500, and presses on the pop-up lever 300 when the trunk lid is closed to compress the spring 200. The arm 400 includes a support block 410 which is connected to the trunk hinge arm 500, a hinge pin 420 which is coupled to an end of the support block 410, a pressure roller 430 which is rotatably fitted over the hinge pin 420 via bushings 440 and contacts the guide surface 320 of the pop-up lever 300, and a support plate 450 which supports the pressure roller 430.

Thus, when the trunk lid is unlocked, the compressed elastic spring 200 is extended, so that the pop-up lever 300 is rotated. As the pop-up lever 300 rotates, the pressure roller 430 moves along the guide surface 320 of the pop-up lever 300. As the pressure roller 430 moves, the hinge arm 500 is rotated at a predetermined angle, so that the trunk lid connected to the trunk hinge arm 500 may be popped up.

Figure 4:
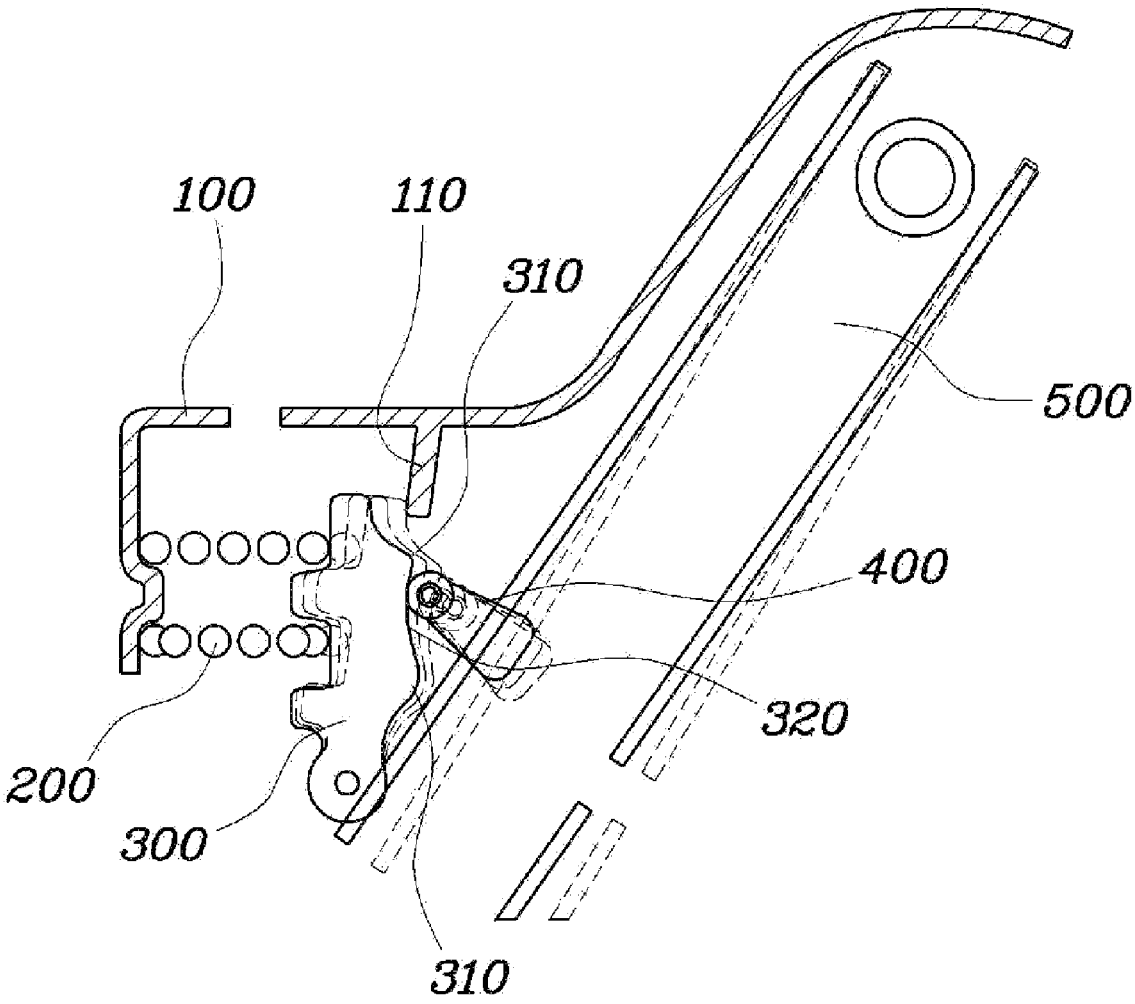
FIG. 4 is a view illustrating the construction of an exemplary stopper of the trunk hinge apparatus having the pop-up function according to the present invention.
Figure 5:
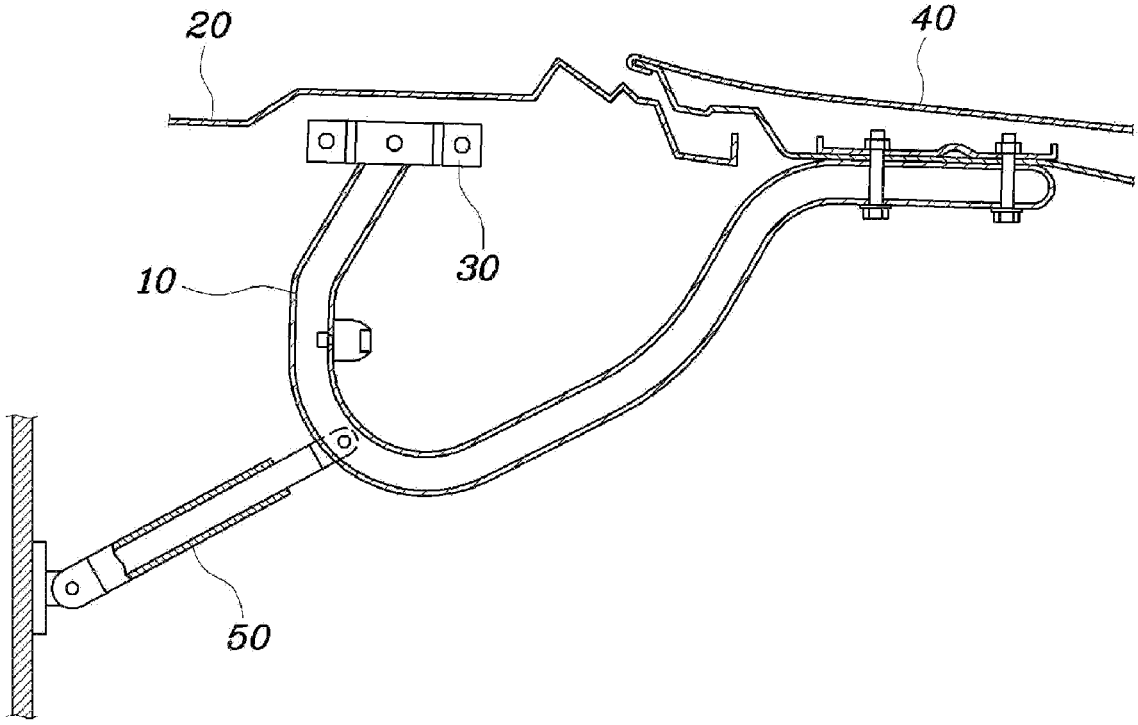
FIG. 5 (Related Art)
FIG. 5 is a view illustrating the construction of a conventional trunk lid hinge apparatus.

As shown in FIG. 4, a stopper 110 may be provided on the hinge bracket 100 in the rotating path of the pop-up lever 300. Thus, the stopper 110 protrudes from the hinge bracket 100 in such a way as to be positioned at the rotating path of the other end of the pop-up lever 300. Thus, the stopper 110 may limit the rotating angle of the pop-up lever 300 when the pop-up lever 300 is rotated.

Further, the rotating angle of the pop-up lever 300 and the angle at which the trunk hinge arm 500 is popped up may be determined according to the position of the stopper 110 relative to the hinge bracket 100.

The angle at which the trunk hinge arm 500 is popped up depends on the rotating angle of the pop-up lever 300. The rotating angle of the pop-up lever 300, and thus the angle at which the trunk hinge arm 500 is popped up can be set by selecting an appropriate position of the stopper 110 relative to the hinge bracket 100.

The operation of various embodiments of the present invention will be described below.

As shown in FIG. 4, when the trunk lid is closed, the elastic spring 200 maintains the compressed state. Meanwhile, when the trunk lid is released (the trunk lid is opened first), the compressed elastic spring 200 is extended.

When the elastic spring 200 is extended, the other end of the pop-up lever 300 rotates around the lever shaft 330 by 4 mm. When the pop-up lever 300 performs such a rotating motion, the pressure roller 430 of the pressure unit 400 moves along the inclined guide surface 320 of the pop-up lever 300, thus rotating the trunk hinge arm 500. As the trunk hinge arm 500 is rotated, the trunk lid may have the initial pop-up amount of about 30 mm.

A trunk hinge apparatus according to the present invention is advantageous in that a trunk hinge structure has a pop-up function, thus allowing a user to easily recognize whether a trunk lid is open or not, and to easily raise the released trunk lid and thereby open the trunk.

Further, a trunk hinge apparatus according to the present invention is advantageous in that it is easy to recognize whether a trunk is open or not, thus obtaining a high score in the North America Initial Quality Study (IQS), and improving the marketability of a product.

For convenience in explanation and accurate definition in the appended claims, the terms "lower", "front", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A trunk hinge apparatus having a pop-up function, comprising:

a hinge bracket mounted to an inner panel;

a trunk hinge arm, an end of which is hinged to the hinge bracket;

an elastic spring secured to the hinge bracket;

a pop-up lever hinged at a first end thereof to the hinge bracket, and elastically biased at a second end thereof by the elastic spring; and a pressure unit mounted to the trunk hinge arm which slidably contacts the pop-up lever.

2. The trunk hinge apparatus having the pop-up function as set forth in claim 1, wherein a guide surface is provided between a pair of jaws on the pop-up lever so that the pressure unit moves along the guide surface and thereby a trunk lid engaged to the other end of the trunk hinge arm is popped up when the trunk lid is opened.

3. The trunk hinge apparatus having the pop-up function as set forth in claim 2, wherein the pressure unit comprises:

a support block secured to the trunk hinge arm;

a hinge pin coupled to an end of the support block; and a pressure roller rotatably fitted over the hinge pin.

4. The trunk hinge apparatus having the pop-up function as set forth in claim 3, wherein a stopper is provided at a predetermined position on the hinge bracket to limit a rotating angle of the pop-up lever.

5. The trunk hinge apparatus having the pop-up function as set forth in claim 4, wherein the stopper protrudes from the hinge bracket in such a way as to be placed on a path along which the second end of the pop-up lever is rotated.

6. The trunk hinge apparatus having the pop-up function as set forth in claim 2, wherein the guide surface is concave.

7. A trunk lid assembly comprising the trunk hinge apparatus having the pop-up function as set forth in claim 1; and a trunk lid engaged to the other end of the trunk hinge arm.

8. A passenger vehicle comprising the trunk lid assembly as set forth in claim 7.

9. A trunk hinge apparatus having a pop-up function, comprising:

a hinge bracket;

a trunk hinge arm, an end of which is hinged to the hinge bracket;

a spring attached to the hinge bracket;

a pop-up lever hinged at a first end thereof to the hinge bracket, and biased at a second end thereof by the spring; and an additional arm mounted to the trunk hinge arm and slidably contacting the pop-up lever such that when the spring moves the pop-up lever, the additional arm slides along the pop-up lever, moving the trunk hinge arm.

10. The trunk hinge apparatus as set forth in claim 9, wherein the pop-up lever comprises a concave guide surface which the additional arm slidably contacts.

11. The trunk hinge apparatus as set forth in claim 9, wherein the additional arm comprises:

a support block secured to the trunk hinge arm;

a hinge pin coupled to the support block; and a pressure roller rotatably fitted over the hinge pin.

12. The trunk hinge apparatus as set forth in claim 9, wherein the hinge bracket comprises a stopper to limit a rotating angle of the pop-up lever.

13. The trunk hinge apparatus as set forth in claim 12, wherein the stopper is disposed along a path along which the pop-up lever rotates.

14. A trunk lid assembly comprising the trunk hinge apparatus having the pop-up function as set forth in claim 9; and a trunk lid engaged to the other end of the trunk hinge arm.

15. A passenger vehicle comprising the trunk lid assembly as set forth in claim 14.

* * * * *